US008899897B2

(12) United States Patent
Maurice et al.

(10) Patent No.: US 8,899,897 B2
(45) Date of Patent: Dec. 2, 2014

(54) ICE SCREW FOR FORMING A REMOVABLE BELAY POINT HAVING A SHARPENING RESERVE AT THE BASE OF EACH TOOTH

(71) Applicant: Zedel, Crolles (FR)

(72) Inventors: Alain Maurice, Saint Hilaire du Touvet (FR); Guillaume Bonnet, Grenoble (FR)

(73) Assignee: Zedel, Crolles (FR)

( * ) Notice: Subject to any disclaimer, the term of this patent is extended or adjusted under 35 U.S.C. 154(b) by 124 days.

(21) Appl. No.: 13/689,007

(22) Filed: Nov. 29, 2012

(65) Prior Publication Data

US 2013/0136561 A1 May 30, 2013

(30) Foreign Application Priority Data

Nov. 29, 2011 (FR) ..... 11 03633

(51) Int. Cl.
*F16B 45/00* (2006.01)
*A63B 29/00* (2006.01)
*A63B 29/02* (2006.01)

(52) U.S. Cl.
CPC ..... *A63B 29/025* (2013.01); *F16B 45/00* (2013.01)
USPC ..... 411/387.1; 411/400

(58) Field of Classification Search
USPC ..... 411/387.1, 387.2, 400, 401; 408/204, 408/206; 175/18
See application file for complete search history.

(56) References Cited

U.S. PATENT DOCUMENTS

| | | | | |
|---|---|---|---|---|
| 448,126 | A * | 3/1891 | Craig | 408/204 |
| 3,025,917 | A * | 3/1962 | Knoblauch | 175/18 |
| 3,387,637 | A * | 6/1968 | Ferguson et al. | 408/204 |
| 4,714,972 | A | 12/1987 | Biermeier et al. | |
| 5,044,393 | A * | 9/1991 | Jiles | 137/318 |
| 5,529,449 | A * | 6/1996 | McSherry et al. | 411/31 |
| 5,782,442 | A * | 7/1998 | Kwak et al. | 248/231.9 |
| 6,505,799 | B1 * | 1/2003 | Bercaw et al. | 248/231.9 |
| 6,607,340 | B2 * | 8/2003 | Petzl et al. | 411/400 |

FOREIGN PATENT DOCUMENTS

| | | |
|---|---|---|
| CA | 455936 A | 4/1949 |
| EP | 1 491 238 A2 | 12/2004 |
| JP | U-60-182077 | 12/1985 |
| SU | 939891 | 6/1982 |

* cited by examiner

*Primary Examiner* — Flemming Saether
(74) *Attorney, Agent, or Firm* — Oliff PLC

(57) ABSTRACT

An ice screw comprises an elongated shaft with an external thread, and a bit with teeth. Each tooth has a cutting edge, and the bit is provided at a longitudinal end of the shaft. A notch is formed in bit at the base of each cutting edge in order to delimit a sharpening reserve of the associated tooth.

5 Claims, 2 Drawing Sheets

ICE SCREW FOR FORMING A REMOVABLE BELAY POINT HAVING A SHARPENING RESERVE AT THE BASE OF EACH TOOTH

TECHNICAL FIELD OF THE INVENTION

This invention relates to an ice screw for forming a removable belay point, said screw comprising:

an elongated tubular shaft with an external thread;

a bit with teeth, each tooth having a cutting edge, said bit being provided at a longitudinal end of the shaft.

BACKGROUND

In the field of vertical sports, there are removable belay devices, notably of the ice screw type as shown in FIG. 1, comprising an elongated tubular shaft 1 with an external thread 2 and a bit 3 with teeth 4. Bit 3, shown in more detail in FIG. 2, is provided at a longitudinal end $E_{11}$ of shaft 1. Each tooth 4 has a cutting edge 5. Opposite to bit 3, i.e. at the other longitudinal end $E_{12}$ of shaft 1, a head 6 equipped with a fastening lug is fixedly joined to shaft 1. This fastening lug is typically used to form a securing point for a climber and to allow rotation to screw shaft 1 in ice.

Frequently, cutting edges 5 get blunt as bit 3 is used. In such case, a user may, as shown in FIG. 3, perform a maintenance step of his belay device using a sharpening file 7 to grind the edge of tooth 4 at its cutting edge 5. However, such a sharpening is not easy and requires some skill not to cut into shaft 1 of the device. Moreover, if shaft 1 is cut into during the sharpening, this may, in some extreme cases, damage the integrity of the device or its performances in use.

Further, the sharpening of the cutting edge oriented to face the screwing direction and that of another cutting edge of the tooth opposed to the preceding cutting edge, to delimit the top of the tooth, also allows to sharpen the top of the associated tooth in order to obtain a point.

EP 1491238 discloses an ice screw with a bit whose sharpening is complicated to perform.

SU 939891 relates to a tool for drilling a hole in ice. Such a tool does not have an elongated shaft with an external thread and is generally used by fishermen and not by mountaineers. It is to be noted that the tooth is not sharpened on the side. The sharpened area is at the bottom of the tooth.

SUMMARY

The object of the invention is to provide an ice screw whose sharpening is made easier.

This object is neared in that a notch is formed in the bit at the base of each cutting edge in order to delimit a sharpening reserve of the associated tooth.

In an embodiment, the screw has an indicator defining en end-of-life status of said bit. The end-of-life status may be configured to be readied when the cutting edge of one of the teeth matches the bottom of the notch.

Advantageously, the cutting edge of a tooth extends from the top of said tooth to the associated notch.

The notch associated to a tooth may have a concave shape starting from the cutting edge base, opposite the top of the tooth, and ending at the base of the adjacent tooth facing the cutting edge.

In an embodiment, the bit teeth are formed in line with the shaft and each notch is formed along an axis perpendicular to the longitudinal axis of the shaft.

In particular, there may be four bit teeth angularly spaced about the longitudinal axis of the shaft so that the four notches are placed two by two respectively along a first axis and a second axis, said first and second axis being in the same plane and perpendicular to each other, said plane being perpendicular to the longitudinal axis of the shaft.

BRIEF DESCRIPTION OF THE DRAWINGS

Other advantages and features will appear more clearly in the following description of particular embodiments of the invention, given by way of non-limiting examples and illustrated in the accompanying drawings, in which.

DESCRIPTION OF PREFERRED EMBODIMENTS

The ice screw is intended to form a removable belay point and differs notably from prior art in the shape of its bit. In point of fact, the bit is shaped so that each tooth has at its base a sharpening reserve to make easier the maintenance steps cited in the state of the art.

Figure 1:
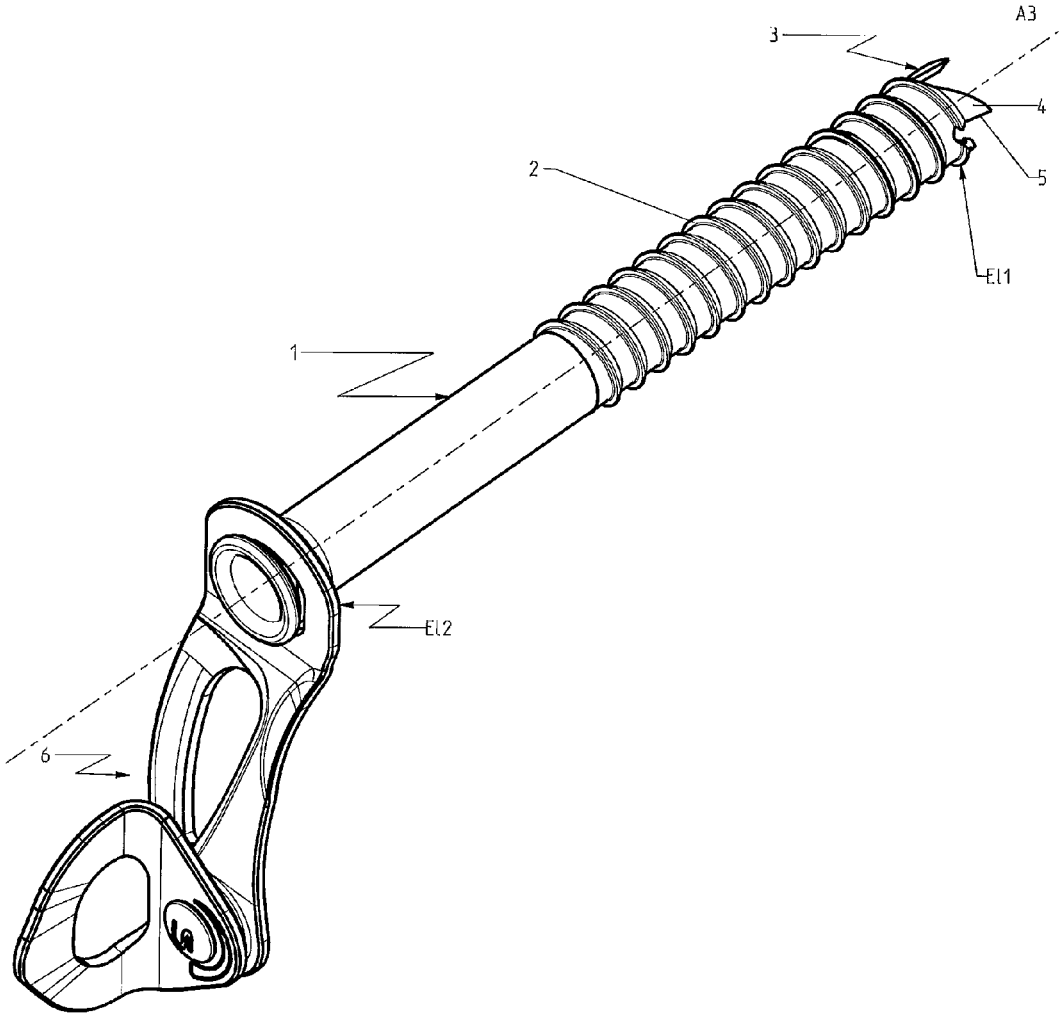
Figure 1 Prior Art
FIG. 1 shows an ice screw according to prior art.

Thus, as in FIG. 1, the ice screw has an elongated tubular shaft 1 with an external thread 2. The thread advantageously allows to make easier the screwing of the shaft body in ice. The screw further has a bit 3 with teeth 4, each tooth 4 having a cutting edge 5. Bit 3 is provided at a longitudinal end $E_{11}$ of shaft 1.

The role of bit 3 is to assist the screw penetration in ice by drilling.

Figure 4:
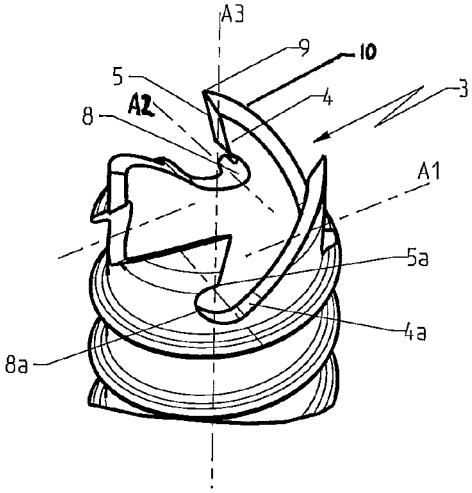
FIG. 4 illustrates a bit according to an embodiment of the invention.

As shown in FIG. 4, a notch 8 is formed in bit 3 at the base of each cutting edge 5 in order to delimit a sharpening reserve of the associated tooth. In other words, each tooth 4 has at its base a notch 8 allowing to make its sharpening easier.

The sharpening reserve allows to have a material reserve usable to reshape a sharp cutting edge 5 should the latter get blunt.

Advantageously, cutting edge 5 of a tooth 4 extends from the top 9 of said tooth 4 to the associated notch 8. In point of fact, base 5*a* of cutting edge 5, opposite the top 9, advantageously matches with an edge of notch 8. This cutting edge 5 may be delimited by a local bevel of tooth 4 forming a sharp and cutting blade on at least one side of the blade.

Figure 2:
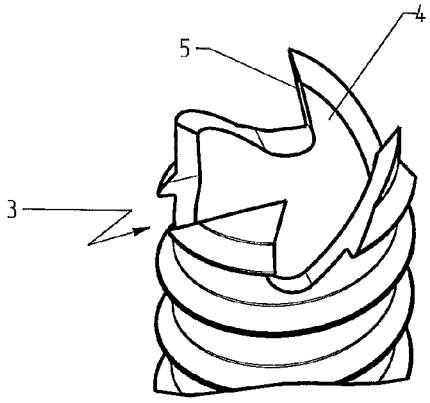
Figure 2 Prior Art
FIG. 2 illustrates a detailed view of the bit of FIG. 1.
Figure 3:
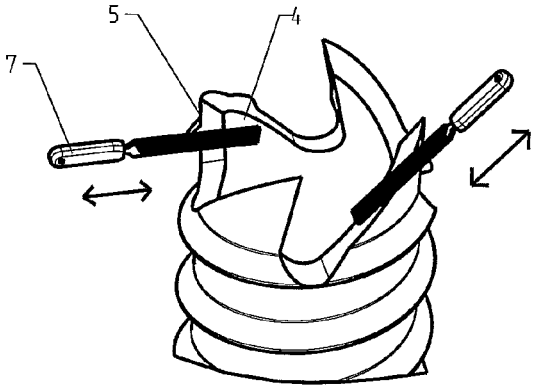
Figure 3 Prior Art
FIG. 3 illustrates a maintenance step performed on the bit of FIG. 2.

In a variant, the ice screw has an indicator defining en end-of-life status of said bit 3. This indicator may have any shape, for example a graduation which, when it is reached, means that bit 3 should not be sharpened anymore, and that the screw must be replaced for safety reasons. Advantageously, this end-of-life indicator may be implemented directly by notch 8 itself, thus the end-of-life status may be reached when cutting edge 5 of one of the teeth 4 matches bottom 8*a* of notch 8. Typically, though not shown, when a tooth 4 of bit 3 of the ice screw has been so sharpened that the entire sharpening reserve has been consumed, this leads to a situation as the one shown in FIGS. 2 and 3, and in that case the ice screw must be replaced.

In a variant, notch 8 associated to a tooth has a concave shape, advantageously of the rounded type, starting from base 5*a* of cutting edge 5, opposite top 9 of tooth 4, and ending at base 4*a* of the adjacent tooth (FIG. 4) facing cutting edge 5. In other words, a notch 8 may have two edges spaced from the bottom of the notch and matching respectively the base of a cutting edge and the base of an associated adjacent tooth.

In an embodiment, teeth 4 of bit 3 are formed in line with shaft 1 and each notch 8 is formed along an axis perpendicular to longitudinal axis A3 of shaft 1. In other words, bit 3 and shaft 1 may be made in one piece.

Advantageously, in FIG. 4, bit 3 has four teeth 4, formed in line with shaft 1 and angularly spaced about longitudinal as A3 of shaft 1, so that advantageously the four notches 8 are placed two by two respectively along a first A1 and a second A2 axis, said first and second axis A1, A2 being in the same plane and perpendicular to each other, said plane being perpendicular to longitudinal axis A3 of shaft 1. This allows, for example, to make easier the manufacture of the screw and its sharpening.

In a particular embodiment, making easier notably the sharpening and the manufacture of the screw, two notches associated to the same first axis, or second axis, each have a circular arc shape whose circle center is located on the associated axis. Moreover, these two notches are advantageously symmetrical to the point of intersection between longitudinal axis A3 of shaft 1 and the first, or second, axis associated to said notches.

Within the context of a use as an ice screw, the tubular shaft is advantageously open at its both ends so that it forms an ice core upon screwing of the screw in ice and allows to draw out this ice core after the screw is taken out from the ice in which it was screwed.

The notch formed at each tooth allows to make easier the sharpening with a file on the entire cutting edge height. Moreover, the notch allows to clearly indicate a sharpening limit of the screw.

As described, bit 3 allows to drill ice, for example during the climb of an ice fall. Thus, bit 3 cooperates with thread 2 when screwing the screw in ice. The cutting edges, associated to the notches, of the different teeth are thus advantageously all oriented in the screwing direction of the ice screw by its end with bit 3.

Advantageously, in the drawings, the internal surface of the tube forming shaft 1 is delimited by a rotational body obtained by the rotation of a straight line about longitudinal axis A3 of tubular shaft 1.

Although a tooth with one cutting edge has been described, the tooth may have several cutting edges. For example, in FIG. 4, the top 9 of the tooth is delimited by two cutting edges 5 and 10 which meet. The sharpening of these edges allows to obtain a tooth as pointed as possible in order to assist the penetration in ice. Notch 8 of a tooth is formed at the base of cutting edge 5 facing the screwing direction (in the example of FIG. 4, the screwing direction corresponds to the counter-clockwise direction).

The invention claimed is:

1. An ice screw for forming a removable belay point, said screw comprising:

an elongated tubular shaft provided with an external thread;

a bit with teeth provided at a longitudinal end of said shaft, each tooth having a cutting edge;

a notch formed in said bit at the base of each cutting edge in order to delimit a sharpening reserve of the associated tooth;

said cutting edge extending from the top of said tooth to the associated notch and including a bevel surface inclined towards an inside of said shaft forming a sharp cutting blade on an outside of said shaft;

said notch having a bottom located rearwardly of the cutting edge in a screw in direction including a bevel surface inclined towards the inside of the shaft defining an axis which is non-coincident with an axis of said shaft.

2. A screw according to claim 1, wherein an indicator is arranged in said notch for defining en end-of-life status of said bit.

3. A screw according to claim 2, wherein the end-of-life status is configured to be reached when said cutting edge of one of teeth matches the bottom of said notch.

4. A screw according to claim 1, wherein the notch associated to a tooth has a concave shape starting from the base of the cutting edge, opposite the top of tooth, and ending at the base of the adjacent tooth facing the cutting edge.

5. A screw according to claim 1, wherein said bit has four teeth angularly spaced about said longitudinal axis of the shaft, so that the four notches are placed two by two respectively along a first axis and a second axis, said first and second axis being in the same plane and located perpendicular to each other, said plane being perpendicular to the longitudinal axis of the shaft.

* * * * *